US010994175B1

(12) United States Patent
deBruin

(10) Patent No.: US 10,994,175 B1
(45) Date of Patent: May 4, 2021

(54) ENCLOSURE AND METHOD FOR BOUNCING A BALL ON A CLUB

(71) Applicant: Leon V. deBruin, Alpine, CA (US)

(72) Inventor: Leon V. deBruin, Alpine, CA (US)

( * ) Notice: Subject to any disclaimer, the term of this patent is extended or adjusted under 35 U.S.C. 154(b) by 0 days.

(21) Appl. No.: 16/530,869

(22) Filed: Aug. 2, 2019

(51) Int. Cl.
*A63B 47/00* (2006.01)
*A63B 69/36* (2006.01)
*A63B 53/04* (2015.01)

(52) U.S. Cl.
CPC ..... *A63B 47/00* (2013.01); *A63B 53/047* (2013.01); *A63B 69/36* (2013.01)

(58) Field of Classification Search
CPC ..... A63B 47/00; A63B 69/36
USPC ..... 473/157–164; 273/330, 340, 410, 440; D6/552
See application file for complete search history.

(56) References Cited

U.S. PATENT DOCUMENTS 1,886,479 A * 11/1932 Greenan ..... A63F 7/0612 273/317.3
2,060,938 A * 11/1936 Johnson ..... A63B 67/002 482/94
3,202,429 A * 8/1965 Richman ..... A63B 57/40 473/194
3,685,833 A * 8/1972 Jack, Jr. ..... A63B 69/3676 473/151
4,022,472 A * 5/1977 Seals ..... A63F 9/0204 273/400
5,074,552 A * 12/1991 Gomez ..... A63B 69/0071 273/402
D382,158 S * 8/1997 Allendorph ..... D6/552
D476,183 S * 6/2003 Bennett ..... D6/552
7,247,105 B2 * 7/2007 Huntsberger ..... A63B 24/0021 473/433
7,927,224 B1 * 4/2011 Ferguson ..... A63B 47/02 473/138

OTHER PUBLICATIONS

M. L. Rose, "How Can Bouncing a Golf Ball Help You?", golftips.golfweek.com/can-bouncing-golf-ball-you-20753.html, archived Sep. 16, 2017 (Year: 2017).*
Jillian Grennon, "Golf Storage Unit" plans, posted online at https://www.buildsomething.com/plans/P8222F5AF937D0ECF/GolfStorageUnit on Apr. 29, 2016 (Year: 2016).*
(Continued)

*Primary Examiner* — Laura Davison
(74) *Attorney, Agent, or Firm* — Palomar Patent; Calif Tervo; MaryJo Redman

(57) ABSTRACT

An enclosure for aiding a user in learning how to repeatedly bounce a ball upward off a club generally comprises an upright side wall surrounding a confined space; the side wall having a front and a middle portion that is vertical and mechanically reflective, and an opening in the front of the wall for insertion of the club and dimensioned for allowing a user to manipulate the club. Many types of balls and bats could be used. For example, a golf ball and golf club can be used with an enclosure dimensioned to facilitate learning to bounce a golf ball. A combination includes a ball, a club, and enclosure. A method includes acquiring the ball, club, and enclosure; inserting the club into the confined space; upwardly propelling the ball from the club; and attempting to repetitively bounce the ball on the club within the enclosure.

10 Claims, 3 Drawing Sheets

(56) References Cited

OTHER PUBLICATIONS

"Kids Basketball Circle Arcade Shooting Game Toddler Stand Toys Outdoor Indoor", https://www.ebay.com/itm/Kids-Basketball-Circle-Arcade-Shooting-Game-Toddler-Stand-Toys-Outdoor-Indoor-/383045783382, Description, revision date Jul. 12, 2019 (Year: 2019).*

* cited by examiner

ENCLOSURE AND METHOD FOR BOUNCING A BALL ON A CLUB

FIELD OF THE INVENTION

The invention relates in general to a confinement enclosure for aiding a user in developing the manual dexterity and eye-hand coordination to bounce a ball, such as a golf ball, on a club, such as a golf club, and further to the combination of ball, club, and enclosure, and also to the method of using the combination.

BACKGROUND OF THE INVENTION

A skill that some people wish to master is to juggle or bounce a ball, such as a golf ball, off a bat, stick or club, such as off the head of a golf club. This bouncing skill enhances eye-hand coordination and manual dexterity.

When learning this bouncing skill, the learner typically drops the ball and attempts to repeatedly hit the ball with an upward movement of club head to keep the ball in the air. When this is first attempted, the ball bounces off the club head in all directions and the learner spends considerable time chasing a missed ball, picking it up, and re-dropping it. Because of this wasted time, many learners quit attempting the procedure before mastering the skill.

Therefore, it is desirable to have a device that aid in keeping a ball "in play" for striking and eliminates much of the wasted time in learning the bouncing skill.

SUMMARY OF THE INVENTION

Figure 1:
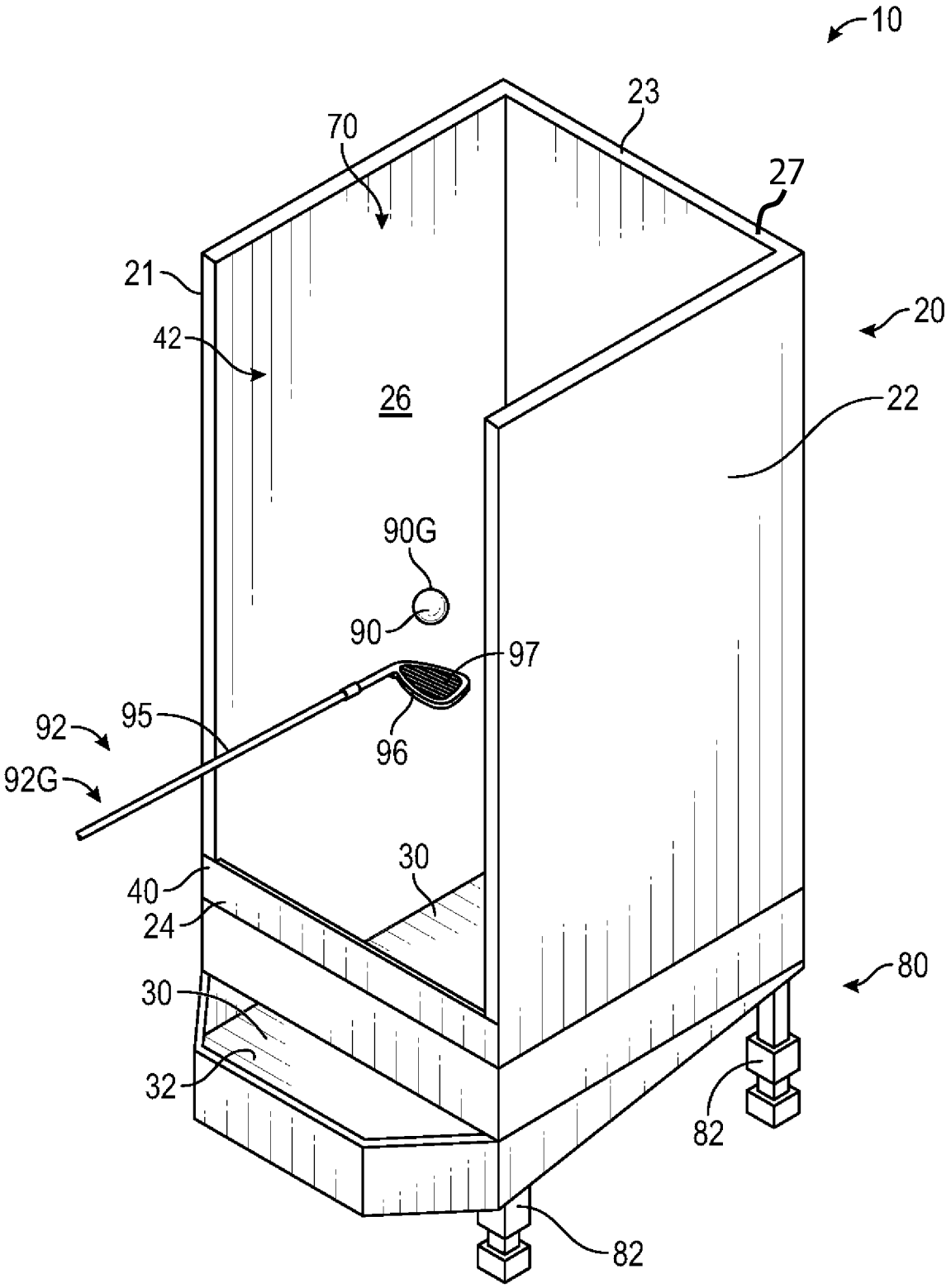
FIG. 1 is a front, left top perspective view of an exemplary embodiment of an enclosure for bouncing a ball on a club, along with a club and a bouncing ball.

The invention is an enclosure for aiding a user in learning how to repeatedly bounce a ball upward off a club having a distal end including a striking surface for striking the ball. The enclosure generally comprises an upright side wall surrounding a confined space; the side wall having a front and a vertical middle portion that is vertical and mechanically reflective such that a ball struck in the confined space and encountering the middle portion will reflect in a predictable manner; and an opening in the front of the wall for insertion of the striking end of the club into the confined space and dimensioned for allowing a user to manipulate the striking surface horizontally and vertically for striking a ball within the confined space so as to bounce the ball upward. In a preferred embodiment, the ball is a golf ball and the enclosure is dimensioned to facilitate learning to bounce a golf ball. A claimed combination includes a ball, a club, and the enclosure.

A method of using the invention includes: acquiring the ball, club, and enclosure; inserting the club into the opening such that the striking surface is in the confined space; upwardly propelling the ball from the striking surface; and attempting to re-propel upwardly, i.e. bounce, the falling ball with the striking surface.

The invention is uniquely designed to facilitate the continuous upward bouncing of ball by a club and developed to "fast pace" assist with manual dexterity, eye hand coordination, neural mechanisms, therapeutic powers of play, and motor- and cognitive-skills.

Other features and advantages of the invention will be readily understood when the detailed description thereof is read in conjunction with the accompanying drawings wherein like reference numerals refer to like parts throughout.

DETAILED DESCRIPTION OF THE INVENTION

Figure 2:
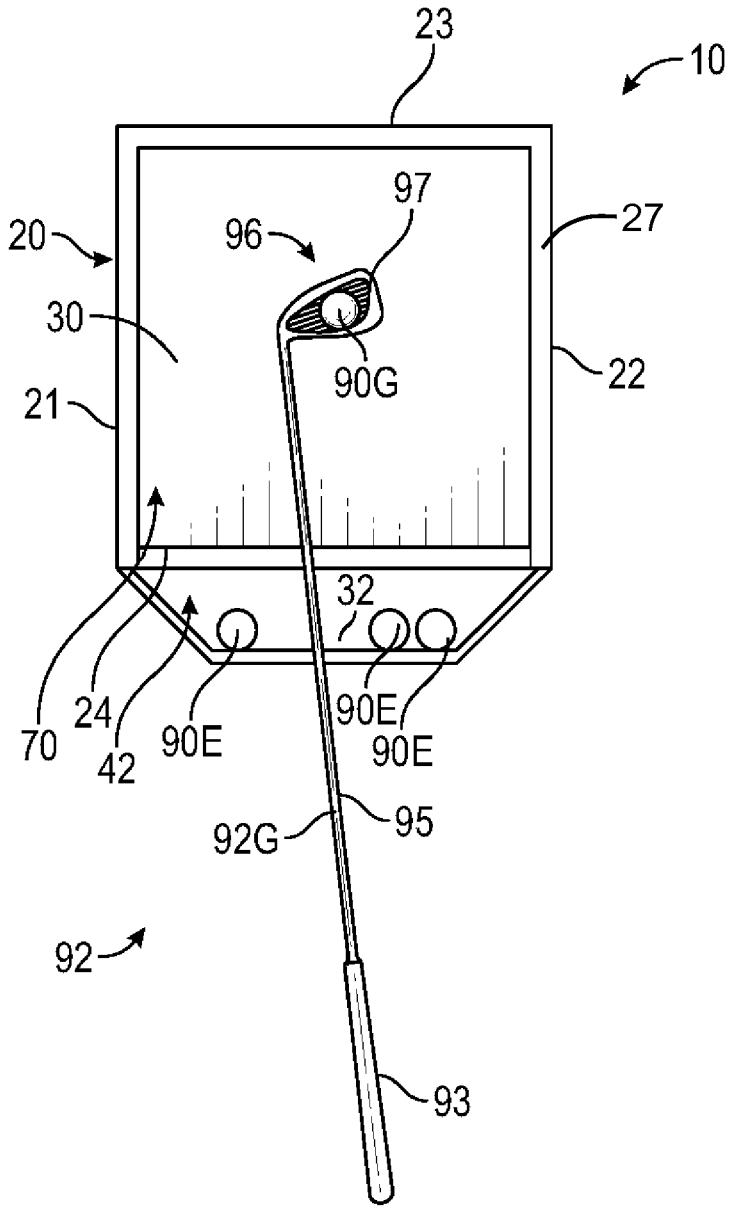
FIG. 2 is a top plan view of the enclosure, club, and ball of FIG. 1.
Figure 3:
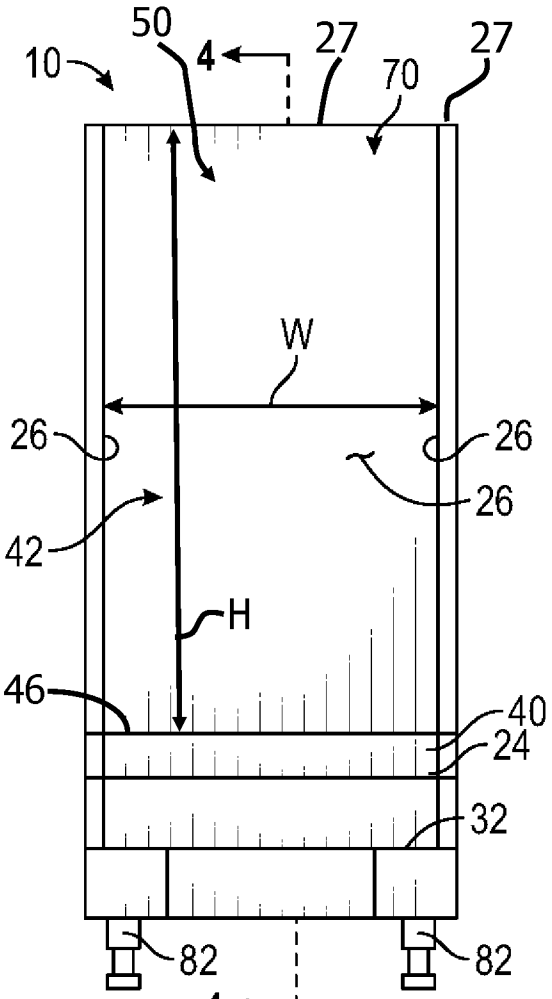
FIG. 3 is a front elevation view of the enclosure of FIG. 1.

FIG. 1 is a front, left top perspective view of an exemplary embodiment of an enclosure, denoted generally as 10, for bouncing a ball 90, such as golf ball 90G shown, on a club 92, such as golf club 92G, shown partially cut away. FIG. 2 is a top plan view of enclosure 10, bouncing golf ball 90G, and club 92G of FIG. 1 with club 92G shown in its entirety, and further showing three extra practice balls 90E in a collection area 32. FIG. 3 is a front elevation view of enclosure 10 of FIG. 1.

Figure 4:
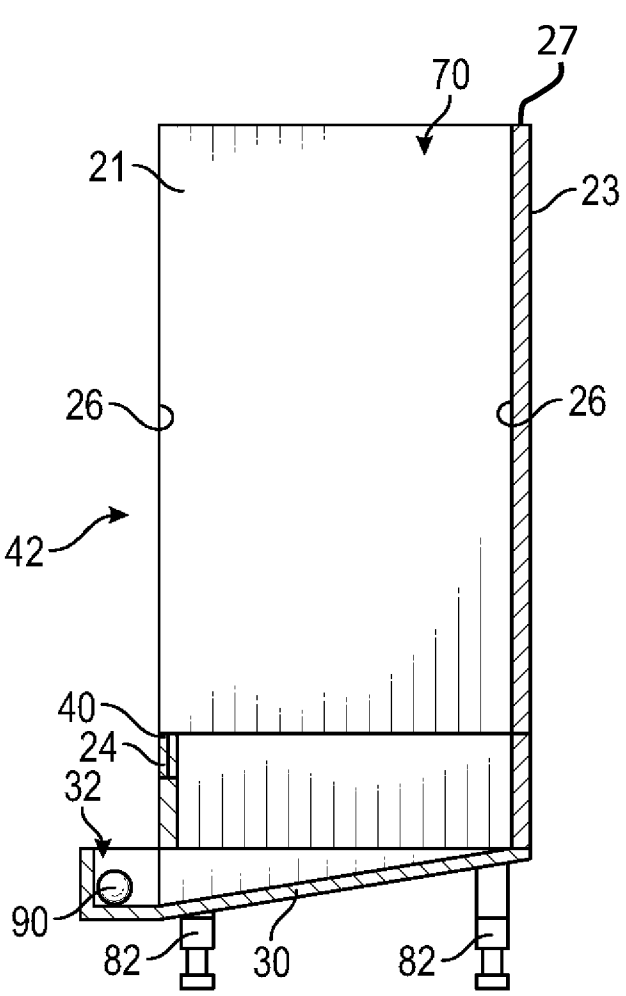
FIG. 4 is a cross-section view taken on line 4-4 of the enclosure of FIG. 3

FIG. 4 is a cross-section view taken on line 4-4 of enclosure 10 of FIG. 3 Although a golf ball 90G is shown and described, the invention is applicable to any ball 90 that can be bounced off a club 92, for example micro-faced round bouncing balls, racquet balls, and hard rubber balls. Although a golf club 92G is shown and described, the invention is applicable to any bat to stick having a striking surface 97 that can bounce a ball 90.

Golf ball 90G may be of conventional type. The United States Golf Association specifies that a golf ball must weigh no more than 1.620 ounces (45.93 g), be spherical in shape and be no less than 1.68 inches (42.7 mm) in diameter. This is called the "American Ball". The "British Ball" is slightly smaller, at 1.62 inches (41.1 mm).

Turning momentarily to FIG. 2, club 92G is a conventional golf club, such as an iron having a length of about 36"-40". Club 92G includes a handle 93, an elongate shaft 95, and a head 96 including striking surface 97, such as a face or flat surface, for striking the ball 90G.

As best seen in FIG. 1, enclosure 10 generally comprises a generally upright side wall 20 and a bottom wall 30. Enclosure 10 may have a top wall such as for confinement or stability, but a top wall typically does not serve any utility with respect to learning to bounce ball 90. Walls 20, 30 surround a confined space 70, except for an opening 42 in front side 40 of side wall 20. Opening 42 is dimensioned for insertion of club head 96 and for insertion of ball 90 such that club head 96 can be moved vertically for striking ball 90 upward off striking surface 97 and can be moved sufficiently horizontally so as to re-strike a ball 90 that was not bounced exactly vertically.

Side wall 20 may be any suitable configuration and composition, such as curved or angular. However, wall 20 of the exemplary embodiment has been found to have advantages as will be explained. Side wall 20 has a middle portion 26. Middle portion 26 of side wall 20 contains most of the flight of a bounced ball 90 and is preferably vertical and rigid such that errant bounced balls 90 encountering middle portion 26 will ricochet or reflect and will do so at a predictable angle such that the user can move club head 96 appropriate for the next striking of ball 90. Side wall 20 may be any suitable mechanically reflective material, such as metal, wood, or plastic.

Side wall 20, as shown in the exemplary embodiment, comprises a left wall 21 and a right wall 22 joined by a back wall 23 and a short lower front wall 24. As best seen in FIG. 3, side wall 20 has an upper end 27, and enclosure 10 has a top opening 50. Opening 42 in front side 40 of side wall 20 extends downward from upper end 27 of side walls 21,22 a vertical height H, and terminates at bottom end 46, well below middle portion 26 of side walls 21, 22, such that club 92 may strike ball 90 below middle portion 26 of side walls 21, 22, and so as to provide an unobstructed view of a ball 90 bounced in the air off club striking surface 97. Opening 42 is above front wall 24. Front wall 24 aids in confining balls 90 that make it past head 96 within confined space 70. Walls 21, 22, 23, 24 are joined at right angles, are approximately the same width, and are vertical and rigid. The width W between side walls 21, 22 is less than fifteen times the diameter of ball 90G and, preferably, width W is about ten times the diameter of ball 90G. This spacing keeps ball 90 in a sufficiently confined volume so that the user can more easily keep ball 90 bouncing. The vertical height H of opening 42 is greater than the width W between middle portions 26 of side walls 21, 22.

Bottom wall 30 is configured such as by slanting, to direct passed balls 90 to a collection area 32 where they are easily accessible to the user so that the user can select one for quickly starting a new bouncing sequence. The user can store extra balls 90E in collection area 32 to keep bouncing sequences ongoing without undue stoppage.

In the preferred embodiment, bottom wall 30 is slanted downward to front wall 24 to direct passed balls to collection area 32 in below and in front of front wall 24. Alternatively, bottom wall 30 could simply direct passed balls 90 to lie adjacent front wall 24. Other configurations of bottom wall 24, as are well-known in ball collection arts, could be used to direct passed balls 90 to a collection area 32 for easy access by a user.

Height-adjustable support means 80 is provided for supporting enclosure at a height desired by the user. In the preferred embodiment, adjustable support means includes a telescopically adjustable legs 82 on each corner. Other adjustable height-adjustable support means are well-known in other art area.

To initiate a bouncing sequence, the user grips club 92, such as on handle 93 or shaft 95, and then inserts head 96 of club 92 into opening 42 such that striking surface 97 is in confined space 70 and is approximately centered between side walls 21, 22. The user upwardly propels ball 90 from striking surface 97 either by dropping ball 90 onto striking surface 97 and striking ball 90 with striking surface 97 or by placing ball 90 on striking surface 97 and then upwardly accelerating striking surface 97 along with ball 90 and abruptly stopping striking surface 97 such that ball 90 continues upward under its own momentum. When the upwardly propelled ball 90 falls, the user attempts to strike it with striking surface 97 to re-propel ball 90 upward. The user attempts to repeatedly re-propel a falling ball 90 upward, i.e. bounce ball 90 off striking surface 97. If ball 90 falls past striking surface 97, user may access it from bottom wall 30 or collection area 32 to initiate another bouncing sequence. Extra balls 90E may be used to more quickly initiate another bouncing sequence.

Typically, the user, especially a beginning user, attempts to propel ball 90 vertically upward as this makes it easier to strike the return ball 90. The user can also strike ball 90 if it is reflected by side wall 20, so side wall 20 helps keep ball 90 in play.

In this manner, the learner does not waste time chasing after hit balls and learns the skills much faster.

I claim:

1. A method of training for bouncing a ball in the air a plurality of times using a club comprising the steps of:

providing a bounceable ball having a diameter;

providing a club having a grip end and a shaft connected to the grip end including a distal end having a striking surface;

providing an enclosure comprising:

an upright side wall having a front and having an upper end and including:

a mechanically reflective, vertical left wall;

a mechanically reflective, vertical right wall disposed parallel to the left wall and spaced less than twenty-five inches therefrom;

a mechanically reflective, vertical back wall; the back wall joining the left wall and the right wall; the right, left, and back walls bordering and defining a confined space having no obstructions to free passage of the ball therein; the right, left, and back walls reflecting the ball in a predictable manner; and a front wall joining the left wall and the right wall; the front wall having an opening receiving the shaft and striking surface; the enclosure and the club dimensioned such that, with the grip end exterior the front opening of the enclosure, the shaft traverses the confined space to the back wall; and holding the club such that the shaft is disposed in the opening and the striking surface faces upward in the confined space;

propelling the ball upwardly in the air with the striking surface in the confined space such that the ball reaches a maximum height and falls downward within the confined space; and striking the falling propelled ball upward in the air with the striking surface within the confined space.

2. The method of claim 1 wherein:

the club is a golf club.

3. The method of claim 1 wherein:

the ball is a golf ball.

4. The method of claim 1 wherein:

the club is a golf club; and the ball is a golf ball.

5. The method of claim 1 wherein: the enclosure includes:

a slanted bottom wall connected to the side wall directing encountered balls to a front collection area for easy access by a user.

6. A method of training for bouncing a ball in the air a plurality of times using a club comprising the steps of:

providing a bounceable ball having a diameter;

providing a club having a grip end and a shaft connected to the grip end including a distal end having a striking surface;

providing an enclosure comprising:

an upright side wall having a front and having an upper end and including:

a mechanically reflective, vertical left wall;

a mechanically reflective, vertical right wall disposed parallel to the left wall and spaced less than twenty-five inches therefrom;

a mechanically reflective, vertical back wall; the back wall joining the left wall and the right wall; the right, left, and back walls bordering and defining a confined space having no obstructions to free passage of the ball therein; the right, left, and back walls reflecting the ball in a predictable manner; and a front wall joining the left wall and the right wall; the front wall having an opening receiving the shaft and striking surface; the enclosure and the club dimensioned such that, with the grip end exterior the front opening of the enclosure, the shaft traverses the confined space to the back wall; wherein: the training enclosure has a top opening permitting entry or exit of the ball anywhere between the left and right walls; and holding the club such that the shaft is disposed in the opening and the striking surface faces upward in the confined space;

propelling the ball upwardly in the air with the striking surface in the confined space such that the ball reaches a maximum height and falls downward within the confined space; and striking the falling propelled ball upward in the air with the striking surface within the confined space.

7. The method of claim 6 wherein:

the club is a golf club.

8. The method of claim 6 wherein:

the ball is a golf ball.

9. The method of claim 6 wherein:

the club is a golf club; and the ball is a golf ball.

10. The method of claim 6 wherein: the enclosure includes:

a slanted bottom wall connected to the side wall directing encountered balls to a front collection area for easy access by a user.

* * * * *